United States Patent [19]

Burton

[11] 4,260,234

[45] Apr. 7, 1981

[54] MEDIA TRANSPORTER FOR PHOTOTYPESETTER-PROCESSOR

[75] Inventor: John S. Burton, Los Angeles, Calif.

[73] Assignee: Autologic, Inc., Newbury Park, Calif.

[21] Appl. No.: 51,524

[22] Filed: Jun. 25, 1979

[51] Int. Cl.[3] ..... G03D 3/08

[52] U.S. Cl. ..... 354/319; 355/28; 226/118

[58] Field of Search ..... 354/90, 319, 320, 321, 354/322, 14, 83, 5; 355/16, 27, 28; 226/118, 119

[56] References Cited

U.S. PATENT DOCUMENTS

| | | | |
|---|---|---|---|
| 3,557,675 | 1/1971 | Koll | 355/28 |
| 3,873,012 | 3/1975 | Wick et al. | 226/118 |
| 3,987,465 | 10/1976 | Sippel | 355/27 |
| 4,115,817 | 9/1978 | Suzuki et al. | 354/83 |
| 4,136,946 | 1/1979 | Nishimoto | 355/16 |
| 4,158,496 | 6/1979 | Cieplik | 354/319 |

*Primary Examiner*—L. T. Hix
*Assistant Examiner*—Alan Mathews
*Attorney, Agent, or Firm*—William H. Maxwell

[57] ABSTRACT

A transporter for delivering cut lengths of exposed film media from a phototypesetter into a film media processor and comprising a series of spaced roller pairs motorized through slip clutches to transport and permit reverse movement of said film media, and when cut adapted to move the film media forwardly at a rate substantially greater than the throughput rate of the phototypesetter which is substantially twice that of the processor, and having a buffer storage area to receive film media delivered from the phototypesetter to be returned thereto or delivered to the film processor, there being a turn gate alternately directing the film media to the buffer storage area and in an emulsion "up" condition or to the film processor for development and delivering the same in emulsion and character "up" sheets cut at the entry thereof into the transporter.

37 Claims, 13 Drawing Figures

TRANSPORTER
PROCESSOR
DEVELOPE
FIX
WASH
DRY
PHOTOTYPESETTER
H
H1
H2
X-X'
Y-Y'
Z-Z'
M-M1
M2
M3
10
12
13
15
16
17
18
19

25
27
28
30
31
32
33
M2

E'
101
CUT SIGNAL
"L"
LOGIC
WAIT SIGNAL
102
111
TRAILING EDGE SENSOR
113
TURN GATE SENSOR
112
EXIT SENSOR
"F"
FAULT CIRCUIT
FAULT SIGNAL
103
"PHOTOTYPESETTER"
40
M
41
M
RELAY
REVERSING RELAY
45
RELAY
BRAKE
RELAY
TURN GATE SOLENOID
37'
"PROCESSOR"
P'
POWER SUPPLY
115 VAC
60 HZ
+12 VDC
+5 VDC
−

MEDIA TRANSPORTER FOR PHOTOTYPESETTER-PROCESSOR

BACKGROUND

The state of the art in setting type provides phototypesetters capable of producing high resolution characters at high speed, for example at speeds up to 8,000 characters per second. The media upon which this typesetting is produced is photographic film or paper intermittently fed from a roll supply of a width to accommodate line lengths up to 100 picas, a media width of nominally four to eighteen inches. The media has a photo sensitive emulsion that is exposed to a cathode ray tube and lens system at a typesetting window where the photocomposition is resolved; there being phototypesetters which produce media with the emulsion side up, and those with the emulsion side down at the output. The exposed media is advanced or retracted at a maximum throughput rate of to six to seven inches per second, and there is an automatic cutter that is electrically responsive to cut the media into varied length sheets as required as it issues from this phototypesetter.

Associated with the above phototypesetter, the state of the art provides media processors that have a throughput rate up to three inches per second, limited to this rate by the dryer function thereof. That is, at this speed the processor is limited by the dryer, and might not sufficiently dry all media at all relative humidity conditions. Therefore, a 2.4 in./sec. throughput rate is more practical and is relied upon. The processor under consideration receives the exposed media emulsion side up only and passes the same through sequentially separate developer, fixer and wash tanks, followed by the aforementioned dryer and deposited into a receiving bin. The developed media is then ready for make-up into page form preparatory to producing the plate used in the actual printing.

A characteristic of newsprint and the like is that the typesetting is organized into columns. For example, a newspaper will be comprised of six columns separated into different news articles between the top and bottom of a page. Accordingly, page composition requires the starting and stopping of the typesetting, for the arrangement of news articles in sequence and in side by side relation, including spaces for pictures and the like. Separation is referred to as "leading" when progressing downwardly, and in the art of phototypesetting "reverse leading" is practiced by reversing the film media and setting other columns of type adjacent to previously set columns of type. Since the throughput rate of the phototypesetter is approximately twice that of the film processor, it is feasible to reverse the phototypesetter a number of times while the processor continues to operate at its full capacity. Therefore, it is an object of this invention to provide a buffer storage of film media in the transporter, for film media in either an emulsion "up" or emulsion "down" disposition.

It is a general object of this invention to provide a transporter to handle the media, whether film or paper, in a manner to eliminate scratches and static, by using rollers and reducing sliding contact to a bare minimum. It is also an object to handle cut lengths of media, ranging in length from a twelve inch minimum to a fifty inch maximum, allowing a leader up to seventeen inches and a trailer up to seven inches on each end of a typeset page of twenty four inches. It is significant therefore that the aforesaid automatic cutter of the phototypesetter preceeds the operations performed by the transporter, also that the input into the processor supersedes the operations performed by the transporter. Accordingly, it is an object of this invention to coordinate the maximum throughput rate of the phototypesetter of 6 and 7 in./-sec. with that of the processor of 2.4–3 in./sec., the transporter being characterized by storage means and control means therefor. In practice, the transporter will function at 12 in./sec., the faster rate providing for a continuous flow of media through the processor when providing a buffering function. Although the throughput rate of end product is limited by the processor, the buffer storage provided in the transporter permits repeated "reverse leading" so that the average rate is that of the processor.

With the first form of transporter disclosed herein, the media is delivered by the phototypesetter emulsion side up as required for the functions of processing. The media is automatically cut into sheet form limited to maximum length by the transporter when it reaches the final set of transporter rollers, or the media may be fed out in shorter lengths as required. As soon as the sheet media is cut from the media issuring from the phototypesetter it accelerates to the 12 in./sec. throughput rate of the transporter. A feature is slip clutch means that permits continuous operation of the transporter rollers at a maximum throughput rate, allowing advancement of the media at the throughput rate of the phototypesetter, allowing retraction of the media into the phototypesetter, allowing said maximum throughput rate of cut media when severed from the phototypesetter, and also preventing bunching of the media against the slower throughput rate of the processor. The media passes through a turn gate where it operates a detector switch before reaching the processor. There is a time delay which ensures positive entry into processor engagement, whereupon the turn gate drops so as to direct the oncoming media, as the case may be, into a buffer storage area thereby accommodating the greater transporter rate of delivery and so that the entire fifty inch of transport length can be occupied by the following length of media during typesetting, protected by the function of the detector switch which inhibits operation of said automatic cutter until the tail of the existing sheet of media releases said switch.

With the second form of transporter disclosed herein the media is delivered by the phototypesetter emulsion side down and therefor requires reversal to an emulsion side up condition as required for the functions of the processor. The media is automatically cut into sheet form of maximum length by the phototypesetter when it reaches the final set of transporter rollers, and it may be fed out to shorter lengths as will be described. As soon as the sheet media is cut from the media issuing from the phototypesetter, it accelerates to the 12 in./sec. rate of the transporter. A feature is slip clutch means that permits optimum operation of the transporter rollers at a maximum throughput rate, allowing advancement of the media at the throughput rate of the phototypesetter, allowing retraction of the media into the phototypesetter, and allowing said maximum throughput rate of cut media when severed from the phototypesetter. A first detector switch senses the presence of media passing through the final set of transporter rollers and activates a motor so that the film media enters the turn gate to be driven by a pair of rollers of the gate and caused to enter into a buffer storage area in an emulsion "down" condition. When the trailer of the cut media releases said first detector switch and after a short time delay the turn gate motor is quickly stopped by means of a brake with the media trailer still engaged between said drive rollers thereof, while said turn gate is rotated to align with the input rollers of the processor. Alignment of the turn gate with the processor input rollers is sensed by a second detector switch to activate the motor forwardly driving the pair of turn gate drive rollers to pull the media from the buffer storage area in an emulsion "up" condition. A third detector switch senses the media entering the processor and by means of a time delay ensures actuation of the turn gate drive rollers until there is positive engagement of the media with the input rollers of the processor. At this point the turn gate motor is stopped and a slip cluth means permits the processor to pull the film media out of the buffer storage area. When the trailer releases said third detector switch, the turn gate and drive rollers return to a buffer mode, and a phototypesetter "wait" mode is released to enable cutting of the next sheet of exposed media.

SUMMARY OF INVENTION

The primary object of this invention is to provide a transporter for typesetting media in the form of sheets of film or paper cut from the delivery of a phototypesetter operating at variable throughput rates as compared with a constant speed processor receiving the same at a relatively lower throughput rate. Proper processing of the exposed film media requires said constant throughput rate, while the typesetting is being performed by moving the film media both forwardly and reversely. In setting narrow columns as they are in newspapers, one column is set up to twenty-four inches, the film media is reversed and then the next column is set, and so on. It is very important to clear the transporter as quickly as possible, and accordingly its throughput rate is substantially greater than that of the typesetter. The transporter herein disclosed has a throughput rate twice that of the phototypesetter and four to five times that of the processor. In practice, the transporter is electromechanical as herein disclosed and operating within a light tight housing that obscures the media that has been exposed to projected light within the phototypesetter and which is to be developed within the processor.

The foregoing and other various objects and features of this invention will be apparent and fully understood from the following detailed description of the typical preferred forms and applications thereof, throughout which description reference is made to the accompanying drawings.

PREFERRED EMBODIMENT

Figure 1:
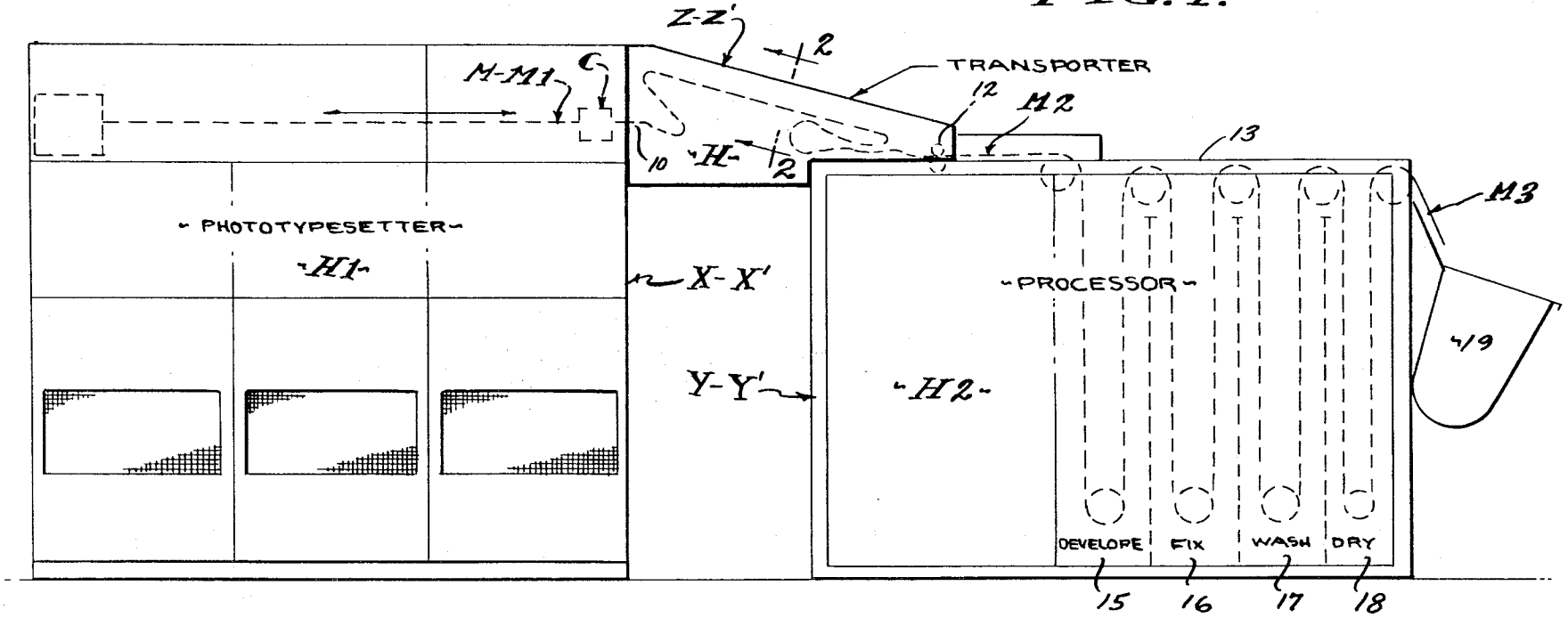
FIG. 1 is a side elevation of a phototypesetter and film processor with the transporter of the present invention extending therebetween.
Figure 2:
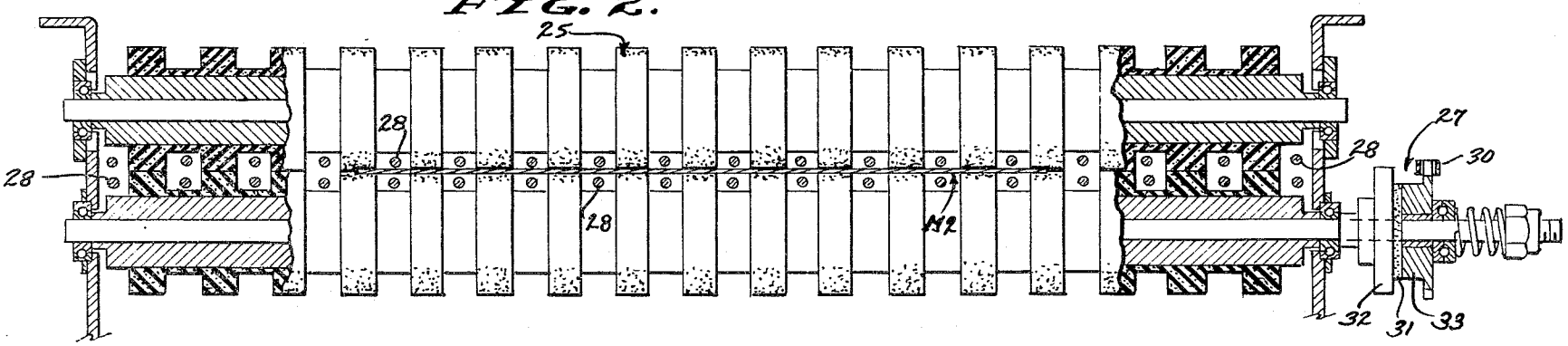
FIG. 2 is an enlarged detailed sectional view of a transporter roller pair, taken as indicated by line 2—2 in FIG. 1.

Referring now to the drawings, the transporter Z of the present invention is utilitarian in combination with a phototypesetter X and processor Y therefor, both of which are highly developed units which are each essentially self sufficient. However, the full advantage of the phototypesetter and/or of the processor therefor cannot be realized when resort is made to the manual transfer of the film media one to the other. Therefore, the expediency of the transporter herein disclosed is highly advantageous and utilitarian, as it ensures maximum throughput rate of the processor by minimizing transfer time from the phototypesetter thereto. Accordingly, the phototypesetter X and processor Y are shown combined with the transporter Z which forms a bridge therebetween, and through all of which light sensitive media M in the form of film or paper is transported for electronic photocomposition, separation into appropriate sheets of composed media, and subsequently developed for delivery in the form of cut sheets of finished typesetting media. The media M is supplied in roll form and varies in width from 3.93 to 17.12 inches, and it is 0.004 to 0.005 resin coated paper or polyester or triacetate base film.

The phototypesetter X (X′) is a photocomposition machine or apparatus that produces exposed photographic sheet media from a storage of fonts and programmed by tape or the like. In practice, electronic circuitry is employed and selected fonts of type are programmed to produce characters on a cathode ray tube focused onto the light sensitive emulsion of the film media M by means of a lens system; all of which is state of the art and forms no part of the present invention. However, there are variations in these phototypesetters in that some (X) produce the typesetting media M in an emulsion "up" disposition, while others (X') produce the typesetting media M1 in an emulsion "down" disposition. The former "up" disposition is most compatible with state of the art processors which require such a disposition, while the latter "down" disposition has its great advantages in the more efficient and practical operation of the phototypesetter per se, but with a requirement that the media M1 be turned over for processing (development). In either case, cut-off of the media into sheet form is a requirement, and to this end there is a cut off means C at a delivery opening 10, where the media M (M1) is delivered either emulsion side up or emulsion side down as the case may be. As shown, the phototypesetter involves a housing H1 in which the means thereof are accommodated and cooperatively related to perform the character composition as circumstances require, producing the exposed typesetting media M (M1) that issues at the delivery opening 10 where it is cut into sheets ranging in length from twenty inches to forty-eight inches or fifty inches. In practice, the housing H1 is light tight with exterior operator controls and access, obscuring the media from accidental exposure. The delivery of media M (M1) is in an elevated horizontal plane, and the cut off means C is electrically activated and immediately adjacent to one end of the housing H1. It is significant that the media issues from delivery opening 10 at a maximum throughput rate of 6 to 7 in./sec. and in both forward and reverse directions, and at an average forward rate limited by the processor throughput rate.

The processor Y is a developing machine or apparatus that finishes the exposed photographic sheet media M2 into typesetting sheet media M2. In practice, this processor is a mechanical device that transports typesetting media sheet M2 through successive tanks of developer 15, fixer 16 and wash water 17 respectively, all of which is followed by a dryer 18 and deposition into a receiving bin 19. In each instance 15–17 there is a depending loop of sheet media M2 extending into a tank for immersion in the developer, fixer and wash water respectively. In the dryer 18 the loop is exposed to blower air for evaporation; and all of which is state of the art and forms no part of the present invention. However, there are features that are significantly peculiar to processors Y of the type under consideration and which require an emulsion "up" disposition of the typesetting sheet media M2, and namely the exposure to processing liquids at the inside of the loop and delivery of the finished product M3 in a right side up disposition. Characteristic of such processors is the reception of media M2 in an elevated horizontal plane and input rollers adapted to continuously feed the media through the processing tanks and dryer. Heretofore, such machines have accommodated cassettes (not shown) of exposed media, to be fed therethrough by reception at the input rollers 12 which are therefor positioned inward from the receiving end of the machine as shown, and at the top 13 thereof above the following process tanks. Normally, the cassette installation and input rollers 12 would be encased within a light cover for obscuring continuous lengths of media to be developed and fixed, and with the present invention said light cover is replaced. The continuously operable input rollers are advantageously employed, the processor involving a housing H2 in which the means thereof are accommodated and cooperatively related to perform the development processes as circumstances require, producing the finished typesetting media M3 delivered into the receiving bin 19, in the form of cut sheets thereof varying in length from twenty inches to forty-eight and fifty inches as above described. In practice, the housing H2 is light tight with exterior controls and access, obscuring the media from accidental exposure. The motivation is by electric motor driving the said input rollers 12 and a plurality of feed rollers 14, and it is significant that the cut sheets of media M3 issue into the bin 19 at a throughput rate of 2.4 to 3 in./sec.

In accordance with this invention, the transporter Z is provided to expedite the supply of cut sheets of media M2 to the processor Y, for continuous processing thereby. Referring to FIG. 1 of the drawings, it will be apparent that the transporter Z is combined with the phototypesetter X and processor Y, to form a bridge therebetween; and it is significant that the transporter Z operates at a substantially greater throughput rate than either X or Y, for example at a throughput rate of 12 in./sec. Accordingly, the delivery of cut sheets of media M2 from the phototypesetter X is quickly accomplished, so that the processor Y can be evenly and continuously supplied with exposed film media. Therefor a feature of this invention is the buffer area 20 which accepts and stores media in excess of that which can enter the processor Y. In other words, the transporter Z has storage means S from which the processor Y can be continuously supplied with media, the storage being quickly filled so that processing can continue and the phototypesetter reversed to resume its operations on another column as quickly as possible. The stored media M2 is in loop form, the maximum length of which is predetermined by a detector switch S1 at a final set of transporter rollers as will be described.

Referring now to the first form of transporter Z shown in FIGS. 1 to 7 of the drawings, the typesetting media M is received by the transporter from the phototypesetter X, and converted to cut sheet form media M2 when the columns to be typeset are completed, in this instance with the emulsion side up which does not require turning over for processing. The transporter involves generally a light tight housing H extending between the housings H1 and H2 of the phototypesetter X and processor Y, a frame F within said housing H, a series of roller pairs 25 carried by the housing, a buffer storage means S, a turn gate G, and a control means E. The roller pairs 25 are spaced approximately five inches apart, and so that fifty inches of media extends from the aforementioned cutter means C to a position ahead of the final pair of said spaced roller pairs. In practice, the delivery plane at the opening 10 of phototypesetter X is not at the same level as the reception plane between the input rollers 12 of the processor Y, the latter being at a lower level. Accordingly, and since it is advantageous to shorten the bridge-like frame F, the series of roller pairs 25 are arranged in other than straight-line configuration, and preferably so as to direct the media upwardly, then rearwardly, and then downwardly and forwardly to the final roller pair 25, there being seven pairs of rollers as shown. Thus, 50 inches of media M extends through the final roller pair before it is necessary to operate the cutter means C.

Referring now to the buffer storage means S, several roller pairs 25 guide the media downwardly and forwardly in a declined plane to the final pair of rollers spaced above the top 13 of the housing H2 where said final roller pair 25 is spaced rearward from the driven input rollers 12 of the processor. Accordingly, there is an area of substantial elevation between said declined plane and top 13 and which extends rearwardly from the final roller pair approximately 14 inches in order to store an unfolded loop of at least 50% of the sheet media M2, several inches of which extends forward to the input rollers 12 of the processor. As shown, the storage means S comprises a forwardly open bin 26 having smooth top, bottom, a forward end and opposite sinde walls, occupying approximately half the frame length as shown. Note that this bin 26 is adapted to receive an entire 50 inch sheet M2 (folded) immediately after it is severed from the media M; assuming that the processor Y has not yet or has just started operating to pull said cut sheet media M2.

In accordance with this invention, the transporter Z is powered to drive the media M forwardly or reversely by means of slip clutch means, forwardly at a maximum rate of 12 in./sec. or at the 6–7 in./sec. throughput rate of the phototypesetter, and reversely at said maximum rate, and until the cutter means C is operated to form the cut sheet media M2, after which cutting it drives the severed media M2 forwardly at the accelerated 12 in./-sec. rate or maximum velocity of the transporter. To this end there is a motor 40 and slip clutch means 27 to each of the roller pairs 25 in series, which permits the moderate slow rate of transport and which inherently accelerates to the maximum rate of transport when restriction thereto is removed. The pairs of rollers 25 are precision ground rubber faced rollers provided with intermediate grooves to pass and/or accomodate film media guide means comprised of wire guides 28 at opposite sides of the media to constrain the paper so as to feed it between successive pairs of rollers in said series. The roller pairs pinch the media slightly so as to prevent slippage thereagainst, each roller pair being driven from a motor 40 by a common drive chain or belt 30 through an individual slip clutch means 27 shown as a spring biased felt 31 between driving discs 32 and 33.

Figure 4:
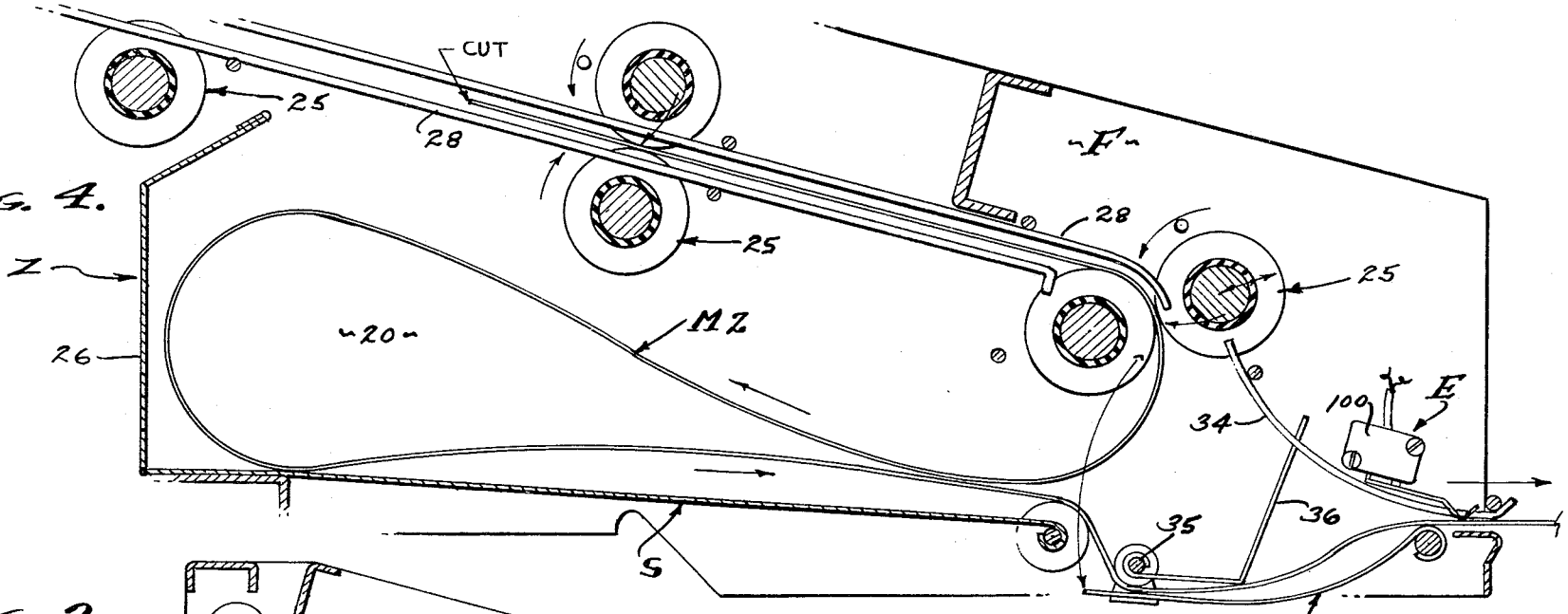
FIG. 4 is an enlarged sectional view of a portion of FIG. 3 showing the buffer storage area and the turn gate in a "down" position for directing media into said area.
Figure 3:
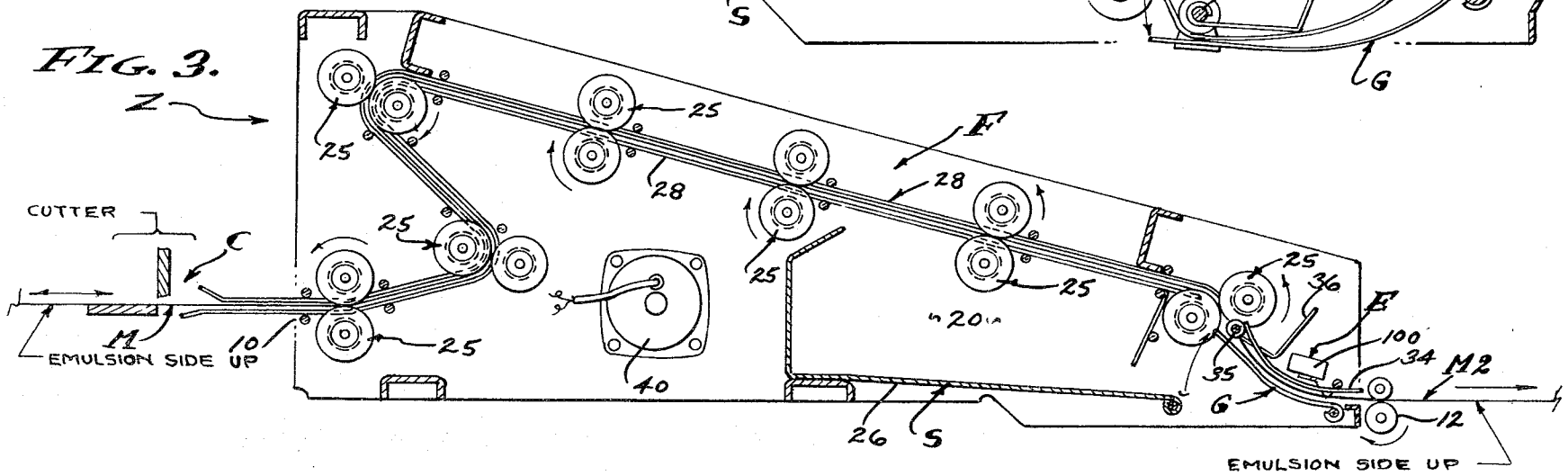
FIG. 3 is an enlarged longitudinal section of the transporter as it appears in FIG. 1, showing a first form of the invention wherein the film media is delivered from the phototypesetter in an emulsion "up" condition, with the housing removed and showing the turn gate in an "up" media reception position.
Figure 6:
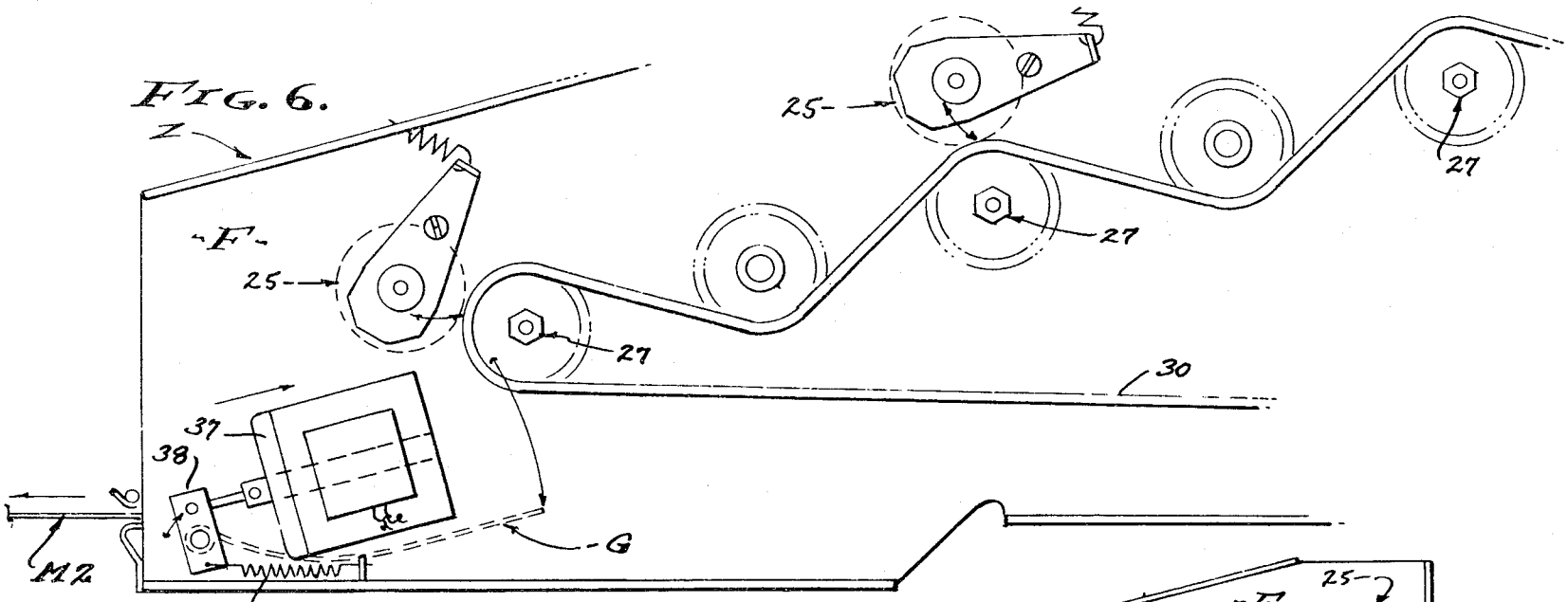
FIG. 6 is an enlarged elevation of a portion of FIG. 5 showing the solenoid driver and the turn gate operated to the "down" position as shown in FIG. 4.
Figure 5:
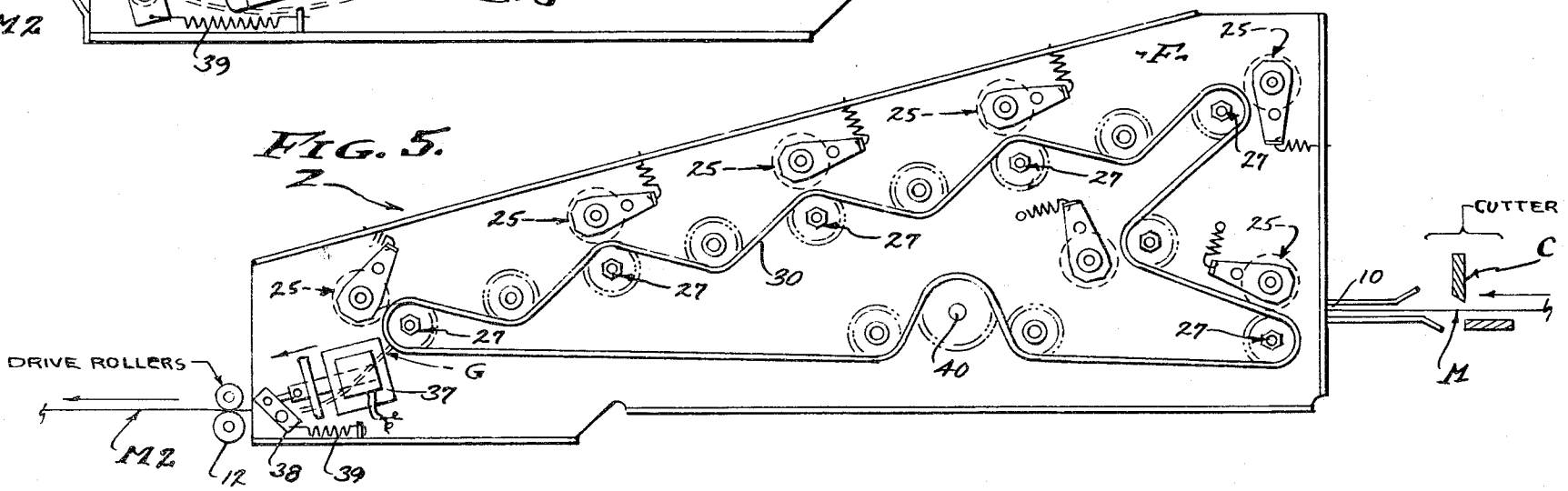
FIG. 5 is a longitudinal view similar to FIG. 3, taken from the opposite side shown in FIGS. 1 and 3, and illustrating the drive for the roller pairs.

Operationally, as the media M starts through the transporter each roller pair engaged thereby slows to the media rate of the phototypesetter X when media remains attached. When the phototypesetter X is in the reverse mode the engaged rollers pairs slip without undue load upon the film media. The turn gate G is operated as shown in FIG. 4 for buffer storage access when the phototypesetter X is ahead of the processor Y. However, when a leading edge of the film media feeds through the roller pairs of the transporter, the turn gate G is operated as shown in FIG. 3 for directing the film media between the input rollers 12 of the processor Y. Upon cutting of the film media by means C, the roller pairs accelerate to the maximum throughput rate of 12 in./sec. for quick transport into the bin 26 of storage means S, the media having been severed into sheet form M2.

The turn gate G has two positions, one (FIG. 3) wherein feed alignment is between the final roller pair 25 and the input rollers 12 of the processor, and the other (FIG. 4) wherein there is an open buffer alignment into the bin 26 of storage means S. In practice, the said final roller pair is disposed to discharge the media M2 downwardly in a plane at an angle of about 20° forward from vertical, there being permanent upper wire guides 34 curved forwardly therefrom to a horizontal alignment immediately above the reception plane between the input rollers 12. The turn gate G is arcuately juxtaposed to said guides 34 when positioned as shown in FIG. 3, with space therebetween to pass the media M2, the gate being pivotally mounted adjacent to and immediately below the reception plane between the input rollers 12. The turn gate G and guides 34 are divergent at the discharge plane between the final roller pair 25 so as to receive a leading edge of media M2, there being a breaker bar 35 therebetween beneath which the leader or media M2 passes. Therefore, the first mentioned feed alignment with rollers 12 passes the media M2 into the processor Y, followed by the second mentioned buffer alignment into bin 26 which passes a loop of media M2 into the buffer storage means S. In practice, fingers 36 extend upward from bar 35 to ensure turning of the media M2 into loop form, and a solenoid driver 37 revolves a lever cam 38 that depresses the turn gate G against a return spring bias 39.

Figure 7:
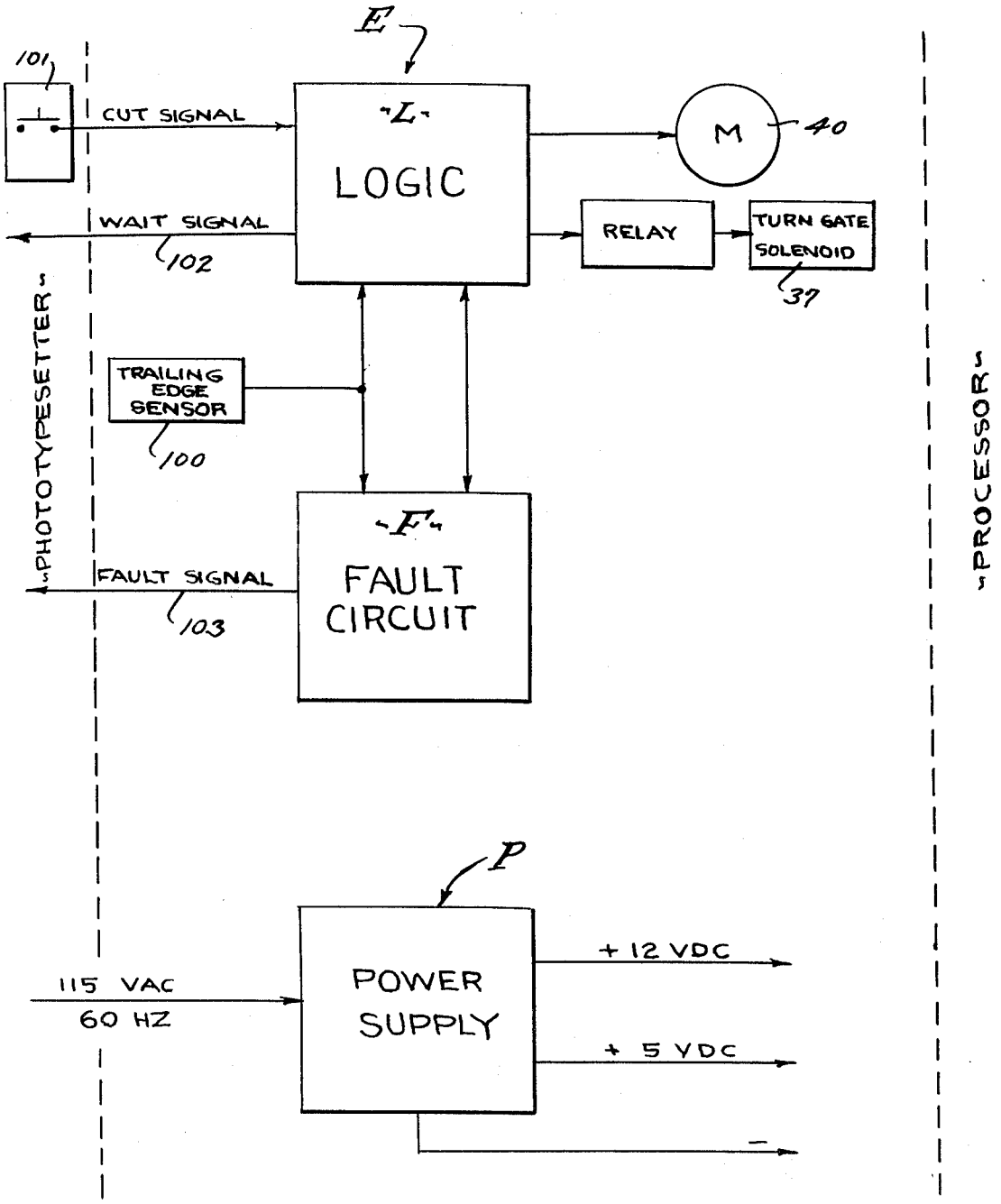
FIG. 7 is a block diagram of the electronic control circuit that governs operation of the first form of transporter shown in FIGS. 1 through 6.

Referring now to the control means E and to the block diagram of FIG. 7, said control means is electrical and comprises a sensor switch 100 at the pivot of turn gate G immediately ahead of the input rollers 12 of the processor Y, the solenoid driver 37 for positioning the turn gate G, a logic circuit means L, a fault circuit means F, and a power supply means P. The power supply means P has the necessary components to generate +12 VDC and +5 VDC from a 115 VAC input, and comprises a transformer, rectifiers and capacitors, a twelve volt regulator, and a five volt regulator. Power control is accomplished by using a latching relay. When the 115 VAC is applied the +12 VDC is generated and is controlled by a Power ON reset swtich that applies the twelve volts to the latching relay when "ON", so as to latch and turn on the system. The latching relay remains on until the Power OFF switch is operated. The Power ON switch also initiates a reset pulse whenever operated, so as to clear and initialize the logic means L.

Timing and operation by the control means E is electronic and in practice is embodied in solid state circuitry with but few exceptions as indicated. The phototypesetter X is provided with a cutter sensor switch 101, and when the trailing edge of the cut media M2 is established by cutting, a momentary signal from switch 101 initiates a timing control which causes the three following functions; (1) a "wait" signal is generated and conducted to the phototypesetter via line 102, (2) a "media IN" transport signal is generated to operate motor 40 in the forward mode, and (3) a 7 second time delay is initiated. The said 7 second time delay is provided to ensure that the cut media M2 is not lost in the transporter Z, and if said time delay times out before a switching signal is received from sensor switch 100 a fault signal will be generated by the fault circuit means F and conducted to the phototypesetter via a line 103. The gate sensor switch 100 closes when film media is present at said switch, and its closure initiates a 180 millisecond time delay which controls the solenoid driver 37. When this 180 millisecond delay times out, a relay is energized which in turn energizes the gate solenoid driver 37. Observe that the sensor switch 100 remains closed so long as there is media in the transporter Z, and as the trailing edge of the fild media M2 moves into the processor Y only then does sensor switch 100 open to reset the logic circuit means L to its initialized state. In practice, a fault will be generated under any one of the following conditions; (1) when the gate sensor switch 100 closes before a cut signal is received from sensor switch 101, indicating that media longer than 48 inches exists in the transporter Z, (2) when the 7 second time delay expires before the gate sensor switch 100 is closed, indicating jammed media or no media in the transporter Z, (3) when the power is off.

Referring now to the second form of transporter Z' shown in FIGS. 8 to 13 of the drawings, the typesetting media M1 is received by the transporter from the phototypesetter X' to be advanced forwardly and reversely and converted to cut sheet form M2 all as above described, but in this instance with the emulsion side down which requires turning over for processing. The transporter Z' involves generally a frame F extending between the housings H1 and H2 of the phototypesetter X' and processor Y, a series of roller pairs 25, the buffer storage means S, a turn gate G' with drive rollers D and control means E'. The roller pairs 25 are spaced approximately 5 inches apart and so that 48 inches of media extends from the aforementioned cutter means C to the final pair of said spaced roller pairs 25. In practice, the delivery plane at opening 10 of the phototypesetter X' is substantially higher than in the first described form, in which case the media first extends downwardly and forwardly before extending upwardly and rearwardly, and then to the final roller pair as in said first described form. Thus 48 inches of media M1 extends to the final roller pair before it is necessary to operate the cutter means C.

The frame F and buffer storage means S of the transporter Z' are essentially the same as that described above with respect to the first form of transporter Z', the final roller pair 25 being downwardly and forwardly disposed at 20° from vertical immediately forward of the open end of the storage bin 26.

The motor drive and slip clutch means of the transporter Z' for each roller pair 25 is essentially the same as that described above with respect to the first form of transporter Z, there being a difference only in application, which involves the reception of media M1 in an emulsion down disposition.

The turn gate G' has two positions, one wherein there is open buffer alignment into the bin 26 of the buffer storage means S, and the other wherein alignment is between storage means S and the input rollers 12 of the processor Y. In practice, the said final roller pair 25 is disposed to discharge the media M2 downwardly in a plane at an angle of about 20° forward from vertical, the turn gate G' comprising spaced guides 34' and 34'' pivotally mounted below the discharge plane of the final roller pair 25, and when in the buffer mode of FIG. 8 to extend downwardly in a plane at an angle of about 30° rearward from vertical and spaced forward of the input rollers 12 of the processor Y. A feature of this form of transporter is the drive rollers D cooperatively involved with the turn gate G', motor driven traction rollers that are reversible for effecting buffer storage or delivery as circumstances require. As shown, there is a pair of pinching drive rollers D carried by the gate pivoted on the axis of one of said rollers journaled in the frame and driven by a motor 41 through a magnetic brake 45 and a slip clutch means 27' as above described re rollers 25. The guides 34' and 34'' are spaced about the feed plane normal to the axis of said two drive rollers, and they are adapted to swing between said two aforementioned alignments to open either at the discharge plane between the final roller pair 25 or reception plane between the input rollers 12. In practice, there is a pair of horizontally disposed guides 44' and 44'' in alignment with said reception plane into rollers 12, to stop the gate G' when operated to deliver media M2 into traction with said input rollers. Therefore, the first mentioned buffer alignment (FIG. 8) is into the bin 26 of the buffer storage means S, the leader of the media M2 striking the bottom of the bin at an obtuse angle so as to be deflected rearward in a direction opposite to its original tranport by the series of roller pairs 25, the motor 41 being operated reversely until a sensor switch 111 detects the presence of the trailing edge of the media M2, and through control means E' next to be described stops the motor 41 and momentarily applies the brake 45, followed by operating said motor reversely with simultaneous alignment of gate G' with input rollers 12. The second mentioned feed alignment (FIG. 9) with input rollers 12 feeds the tail of the media into traction with said rollers. A solenoid driver 37' switches the turn gate G' between the aforesaid two alignments thereof. It will be observed that the turn gate G' turns the media as it is deflected rearward in a direction 180° with respect to forward transport thereof. Accordingly, when the tail of the media is free of the final roller pair 25, the motor 41 is immediately braked and operated reversely to feed the media in an emulsion up disposition and into the input rollers of the processor Y. The reverse operating mode or forward delivery of motor 41 is prolonged a sufficient time to ensure tractive engagement of media which the slip clutch drive of pinch rollers D permits, the processor rollers 12 pulling the media M2 from the buffer storage bin 26.

Figure 13:
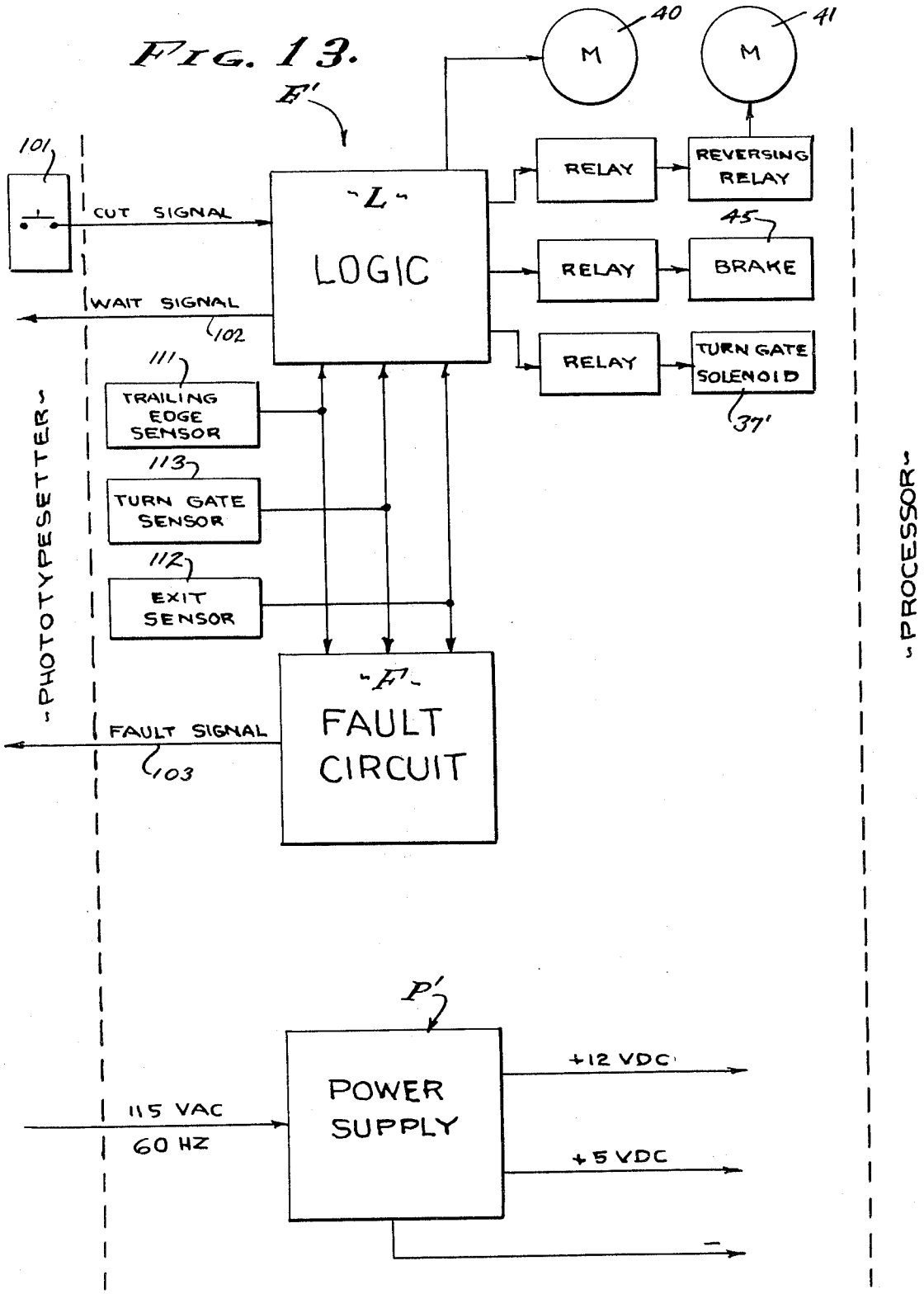

Referring now to the control means E' and to the block diagram of FIG. 13, said control means is electrical and comprises a media sensor switch 111, an exit sensor switch 112, a gate sensor switch 113, the solenoid driver 37' for positioning the turn gate G', a logic circuit means L', a fault circuit means F' and a power supply means P'. The components and operation of the power supply P' to produce +12 VDC and +5 VDC is as above described re the control means E.

Figures 8, 9:
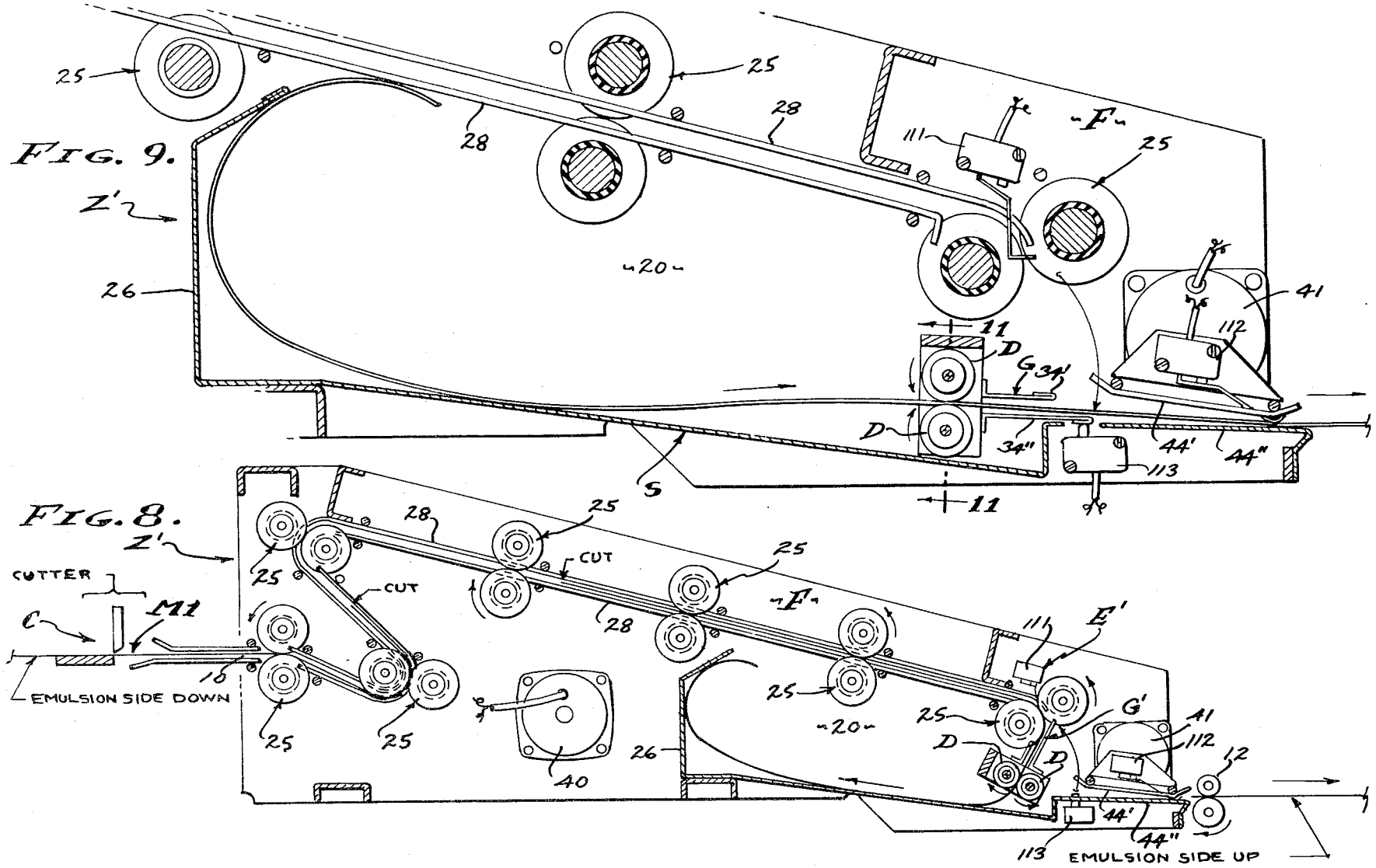
FIG. 8 is a view similar to FIG. 3 showing a second form of the invention wherein the film media is delivered from the phototypesetter in an emulsion "down" condition, and wherein the film media is turned into the buffer storage chamber by the "up" position of the turn gate.
FIG. 9 is an enlarged sectional view of a portion of FIG. 8 showing the buffer storage area and the turn gate in a down position for directing media into the film processor.
Figure 10:
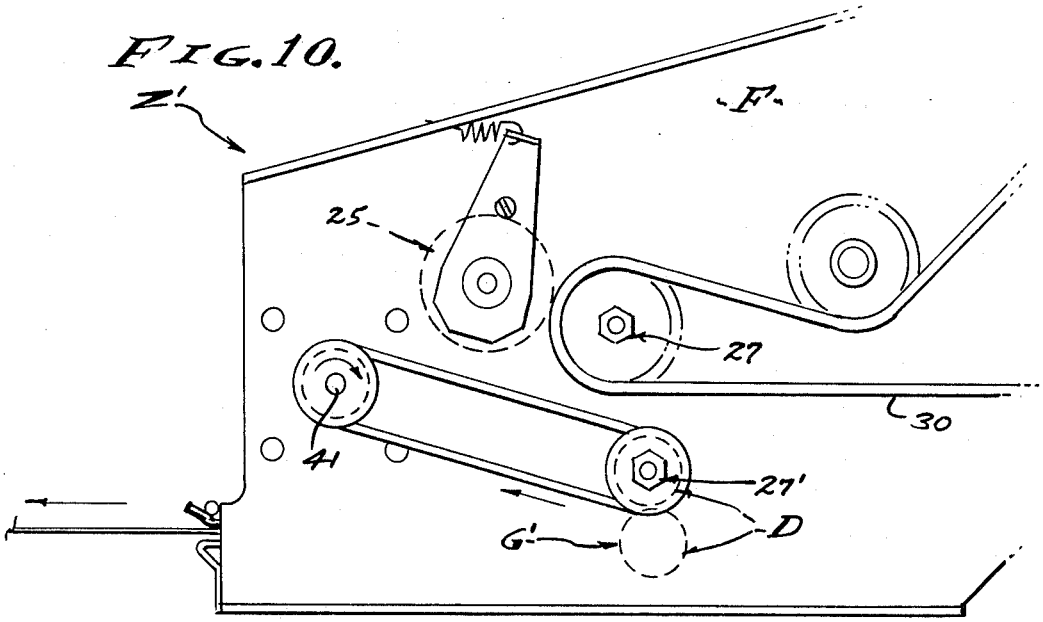
FIG. 10 is an enlarged longitudinal view similar to FIG. 9, taken from the opposite side shown in FIGS. 8 and 9, and illustrating the drive for the roller pairs and drive for the rollers of the turn gate.
Figure 11:
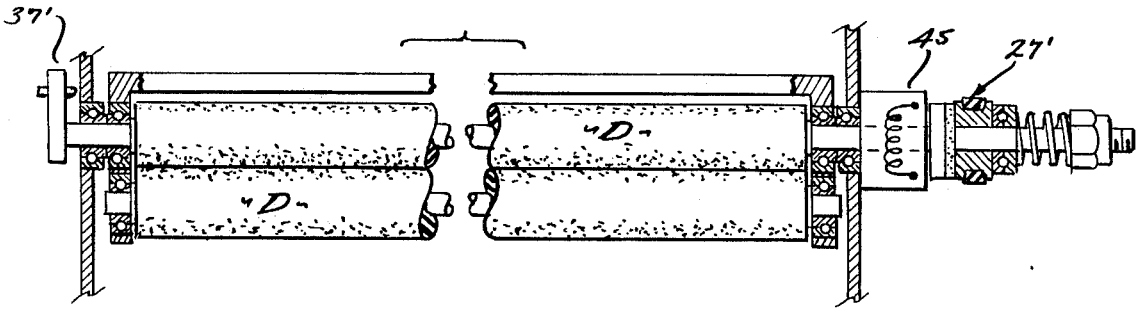
FIG. 11 is a transverse sectional view taken as indicated by line 11—11 on FIG. 9.
Figure 12:
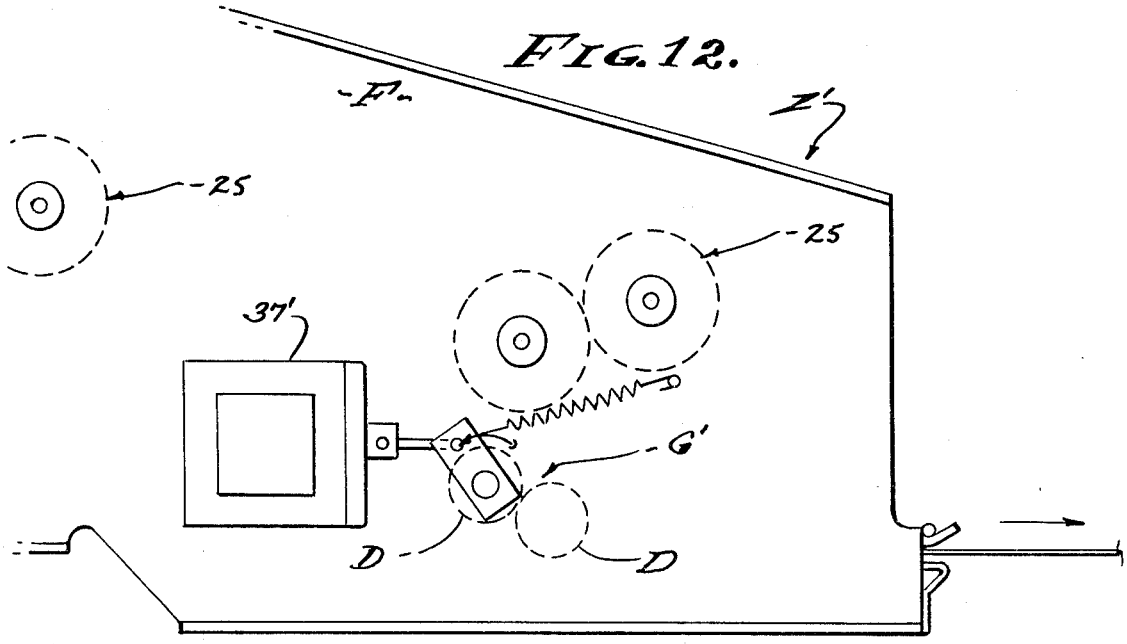
FIG. 12 is an elevation of the end portion of the transporter as shown in FIG. 9. And, FIG. 13 is a block diagram of the electronic control circuit that governs operation of the first form of transporter shown in FIGS. 8 through 12.

Timing and operation by the control means E' is electronic and in practice is embodied in solid state circuitry with but few exceptions, as indicated. The phototypesetter X' is provided with a cutter switch 101 and when the trailing edge of cut media M2 is established by cutting, a momentary signal from switch 101 initiates a timing control which sets up a sequence of events, as follows: The media sensor switch 111 senses the presence of film media between the final set of roller pairs 25 and closure thereof enables the transporter electronics to deenergize solenoid driver 37' and position the turn gate G' as shown in FIG. 8. When the film media M2 passes the sensor switch 111 a time delay signal of 0.16 second is generated so that the turn gate motor 41 is stopped and the brake 45 operated momentarily to ensure that the film media M2 remains engaged between the pinch rollers of the turn gate G'. The turn gate G' is solenoid driven and spring biased to an alignment with guides 44' and 44'' as shown in FIG. 9, closing the gate sensor switch 113 in order to ensure that the gate G' has settled into the exit alignment position. Closure of sensor switch 113 then energizes the turn gate motor 41 in a reverse (exit) direction and simultaneously initiates a time delay of 1 second which ensures that the film media M2 has not been lost in the buffer storage bin 26. As the film media M2 leaves the guides 44' and 44'' the exit sensor switch 112 operates and if it does not do so before switch 113 a fault is indicated. Further, when sensor switch 112 is operated a time delay of 0.10 second is initiated so as to ensure engagement of the film media between the drive rollers 12 of the film processor Y, after which the gate motor 41 is turned off and the media pulled from the transporter Z' by the processor rollers 12. A reset cycle is then initiated to return the turn gate G' to its normal "up" position as shown in FIG. 8, reversing the motor 41 to the next mode enabling the transporter to receive the next cut length of film media M1 or M2 and deliver it into the buffer storage means S. A fault is generated if sensor switch 111 operates when the turn gate G' is down as shown in FIG. 9, or if the time delay initiated by sensor switch 113 times out before sensor switch 112 operates. The faults are latched ON and require manual operation of the reset switch in order to clear, and a fault signal is also sent to the phototypesetter X' if the transporter power is OFF.

Having described only typical preferred forms and applications of my invention, I do not wish to be limited or restricted to the specific details herein set forth, but wish to reserve to myself any modifications or variations that may appear to those skilled in the art as set forth within the limits of the following claims:

I claim:

1. A film media transporter for delivering exposed media from an intermittently operated phototypesetter and into a film processor operating at an average throughput rate of said phototypesetter, and including;

a frame extending from a film media delivery opening of the phototypesetter to a film media reception opening of the film processor, film media guide means carried by the frame to receive film media from the phototypesetter delivery opening and to deliver the same toward and spaced from the film processor reception opening, a series of roller pairs motorized through slip clutch means at a forward transport rate substantially faster than the forward delivery rate of film media from the phototypesetter and engageably receiving and forwardly transporting the film media therebetween and through said guide means, whereby reverse transport is permitted for retraction of film media into the phototypesetter, buffer storage means to receive a loop of film media in excess thereof received through the reception opening of the film processor, and a turn gate extending alternately between the guide means and the buffer storage means for alternate storage of and delivery of the film media to the film processor reception opening.

2. The film media transporter as set forth in claim 1, wherein the frame is elongated to extend between the phototypesetter and film processor and is of a length to accomodate a substantially full sheet length of film media from said phototypesetter.

3. The film media transporter as set forth in claim 1, wherein the delivery rate of the phototypesetter is substantially faster than the processing rate of the film processor.

4. The film media transporter as set forth in claim 1, wherein each roller pair of the series of roller pairs is individually motorized through said slip clutch means, and wherein the delivery rate of the phototypesetter is substantially faster than the processing rate of the film processor.

5. The film media transporter as set forth in claim 1, wherein the turn gate is moved alternately between the guide means and buffer storage means by a driver actuated by a sensor responsive to the presence of film media at the delivery end of the transporter.

6. The film media transporter as set forth in claim 1, wherein the film media guide means is comprised of spaced guides coextensive of the two sides of the film media and terminating at a final roller pair to discharge film media to said turn gate.

7. The film media transporter as set forth in claim 1, wherein the phtotypesetter has cutter means at the film delivery opening to sever the film media into sheet lengths for fast transport when cut to a sheet length.

8. The film media transporter as set forth in claim 1, wherein the film processor has a pinch roller feed to engageably receive film media therebetween at the reception opening thereof.

9. The film media transporter as set forth in claim 1, wherein the phototypesetter has cutter means at the film delivery opening to sever the film media into sheet lengths, and wherein the film processor has pinch roller feed means to engageably receive film media therebetween at the reception opening thereof for fast transport into the film processor pinch roller feed means when cut to sheet length.

10. The film media transporter as set forth in claim 1, wherein the phototypesetter has cutter means at the film delivery opening to sever the film media into sheet lengths, wherein the film processor has pinch roller feed means to engageably receive film media therebetween at the reception opening thereof for fast transport into the film processor pinch roller feed means when cut to sheet length, wherein the frame is elongated to extend between the phototypesetter and film processor and is of a length to accomodate a substantially full sheet length of film media from said phototypesetter, wherein the buffer storage means is adapted to receive a substantially full sheet length of film media from said guide means, wherein the film media guide means is comprised of spaced guides coextensive of the two sides of the film media and terminating at a final roller pair to discharge film media to said turn gate, wherein the delivery rate of the phototypesetter is substantially faster than the processing rate of the film processor, and wherein the turn gate is moved alternately between the guide means and buffer storage means by a driver actuated by a sensor responsive to the presence of film media at the delivery end of the transporter.

11. A film media transporter for delivering exposed emulsion side up media from an intermittently operated phototypesetter and into an emulsion side up film processor operating at an average throughput rate of said phototypesetter, and including;

a frame extending from a film media delivery opening of the phototypesetter to a film media reception opening of the film processor, film media guide means carried by the frame to receive film media from the phototypesetter delivery opening and to deliver the same toward and spaced from the film processor reception opening, a series of roller pairs motorized through slip clutch means at a forward transport rate substantially faster than the forward delivery rate of film media from the phototypesetter and engageably receiving and forwardly transporting the film media therebetween and through said guide means whereby reverse transport is permitted for retraction of film media into the phototypesetter, buffer storage means disposed below the guide means to receive a loop of film media in excess thereof received through the reception opening of the film processor, and a turn gate pivoted below the film media at the reception opening into the film processor and positioned alternately in alignment with said guide means and buffer storage means for alternate storage of and delivery of the film media to the film processor reception opening.

12. The emulsion up film media transporter as set forth in claim 11, wherein the frame is elongated to extend between the phototypesetter and film processor and is of a length to accomodate a substantially full sheet length of film media from said phototypesetter.

13. The emulsion up film media transporter as set forth in claim 11, wherein the delivery rate of the phototypesetter is substantially faster than the processing rate of the film processor.

14. The emulsion up film media transporter as set forth in claim 11, wherein each roller pair of the series of roller pairs is individually motorized through said slip clutch means, and wherein the delivery rate of the phototypesetter is substantially faster than the processing rate of the film processor.

15. The emulsion up film media transporter as set forth in claim 11, wherein the turn gate underlies the film media juxtaposed to overlying guides extending to the film processor reception opening, when said turn gate is aligned with said film media guide means.

16. The emulsion up film media transporter as set forth in claim 11, wherein the turn gate aligns with a wall of the buffer storage means spaced below said film media guide means, when alternately extended thereto.

17. The emulsion up film media transporter as set forth in claim 11, wherein the turn gate aligns with a wall of the buffer storage means spaced below said film media guide means, when alternately extended thereto, and wherein the turn gate underlies the film media juxtaposed to overlying guides extending to the film processor reception opening, when said turn gate is aligned with said film media guide means.

18. The emulsion up film media transporter as set forth in claim 11, wherein the turn gate aligns with a wall of the buffer storage means spaced below said film media guide means when alternately extended thereto, wherein the turn gate underlies the film media juxtaposed to overlying guides extending to the film processor reception opening when said turn gate is aligned with said film media guide means, and wherein the delivery rate of the phototypesetter is substantially faster than the processing rate of the film processor.

19. A film media transporter for delivering emulsion side down media from an intermittently operated phototypesetter and into an emulsion side up film processor operating at an average throughput rate of said phototypesetter, and including;

a frame extending from a film media delivery opening of the phototypesetter to a film media reception opening of the film processor, film media guide means carried by the frame to receive film media from the phototypesetter delivery opening and to deliver the same to and spaced from the film processor reception opening, a series of roller pairs motorized through slip clutch means at a forward transport rate substantially faster than the forward delivery rate of film media from the phototypesetter and engageably receiving and forwardly transporting the film media therebetween and through said guide means whereby reverse transport is permitted for retraction of film media into the phototypesetter, buffer storage means disposed below the guide means to receive a loop of film media in excess thereof received through the reception opening of the film processor, and a turn gate pivoted below the guide means in open communication with the buffer storage means and in spaced relation to the film processor reception opening and positioned alternately in alignment with said guide means and said reception opening for alternate storage of an delivery of the film media to the film processor reception opening.

20. The emulsion down film media transporter as set forth in claim 19, wherein the frame is elongated to extend between the phototypesetter and film processor and is of a length to accomodate a substantially full sheet length of film media from said phototypesetter.

21. The emulsion down film media transporter as set forth in claim 19, wherein the delivery rate of the phototypesetter is substantially faster than the processing rate of the film processor.

22. The emulsion down film media transporter as set forth in claim 19, wherein each roller pair of the series of roller pairs is individually motorized through said slip clutch means, and wherein the delivery rate of the phototypesetter is substantially faster than the processing rate of the film processor.

23. The emulsion down film media transporter as set forth in claim 19, wherein the phototypesetter has cutter means at the film delivery opening to sever the film media into sheet lengths, and wherein the turn gate comprises a pair of reversibly motorized drive rollers engageably receiving sheet length film media therebetween for transport into and out of said buffer storage means.

24. The emulsion down film media tranporter as set forth in claim 19, wherein the phototypesetter has cutter means at the film delivery opening to sever the film media into sheet lengths, and wherein the turn gate comprises a pair of spaced guides to alternately align with the said film guide means and the said film processor reception opening, and a pair of reversibly motorized drive rollers engageably receiving sheet length film media therebetween for transport into and out of said buffer storage means.

25. The emulsion down film media transporter as set forth in claim 19, wherein the phototypesetter has cutter means at the film delivery opening to sever the film media into sheet lengths, wherein the turn gate comprises a pair of reversibly motorized drive rollers engageably receiving sheet length film media therebetween for transport into and out of said buffer storage means, and wherein a sensor responsive to the presence of film media at the final roller pair energizes the motorized drive rollers to transport the film media into the buffer storage means with said turn gate aligned with said guide means.

26. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, and wherein a sensor positioned at and responsive to a trailing end of the film media leaving the final roller pair de-energizes the motorized drive rollers and energizes a driver to position the turn gate aligned with the film processor reception opening.

27. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, and wherein a sensor positioned at and responsive to the presence of film media at the final roller pair energizes the motorized drive rollers to transport the film media into the buffer storage means with said turn gate aligned with said guide means, and responsive to a trailing end of the film media leaving the final roller pair to de-energize the motorized drive rollers and energize a driver to position the turn gate aligned with the film processor reception opening.

28. The emulsion down film media transporter as set forth in claim 19, wherein the phototypesetter has cutter means at the film delivery opening to sever the film into sheet lengths, wherein the turn gate comprises a pair of reversibly motorized drive rollers engaeably receiving sheet length film media therebetween for transport into and out of said buffer storage means, and wherein a sensor positioned at and responsive to a trailing end of the film media leaving the final roller pair de-energizes the motorized drive rollers and energizes a momentary brake means and a driver to position the turn gate.

29. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, and wherein a sensor positioned at and responsive to the presence of film media at the final roller pair energizes the motorized drive rollers to transport the film media into the buffer storage means with said turn gate aligned with said guide means, and responsive to a trailing end of the film media leaving the final roller pair to de-energize the motorized drive rollers and energize a momentary brake means and a driver to position the turn gate aligned with the film processor reception opening.

30. The emulsion down film media transporter as set forth in claim 19, wherein the phototypesetter has cutter means at the film delivery opening to sever the film media into sheet lengths, and wherein the turn gate comprises a pair of reversibly motorized drive rollers engageably receiving sheet length film media therebetween for transport into and out of said buffer storage means, and wherein a sensor responsive to the turn gate in alignment with the film processor reception opening energizes the motorized drive rollers to transport the film media out of the buffer storage means.

31. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for tranport into and out of said buffer storage means, wherein a sensor positioned at and responsive to a trailing end of the film media leaving the final roller pair de-energizes the motorized drive rollers and energizes a driver to position the turn gate aligned with the film processor reception opening, and wherein a sensor responsive to the turn gate alignment with the film processor reception opening energizes the motorized drive rollers to transport the film media out of the buffer storage means.

32. The emulsion down media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, wherein a sensor positioned at and responsive to the presence of film media at the final roller pair energizes the motorized drive rollers to transport the film media into the buffer storage means with said turn gate aligned with said guide means, and responsive to a trailing end of the film media leaving the final roller pair to de-energize the motorized drive rollers and energize a driver to position the turn gate aligned with the film processor reception opening, and wherein a sensor responsive to the turn gate in alignment with the film processor reception opening energizes the motorized drive rollers to transport the film media out of the buffer storage means.

33. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, wherein a sensor positioned at and responsive to a trailing end of the film media leaving the final roller pair de-energizes the motorized drive rollers and energizes a momentary brake means and a driver to position the turn gate, and wherein a sensor responsive to the turn gate in alignment with the film processor reception opening energizes the motorized drive rollers to transport the film media out of the buffer storage means.

34. The emulsion down film media transporter as set forth in claim 19, wherein the phototypesetter has cutter means at the film delivery opening to sever the film into sheet lengths, wherein the turn gate comprises a pair of reversibly motorized drive rollers engageably receiving sheet length film media therebetween for transport into and out of said buffer storage means, wherein a sensor positioned at and responsive to the presence of film media at the final roller pair energizes the motorized drive rollers to transport the film media into the buffer storage means with said turn gate aligned with said guide means, and responsive to a trailing end of the film media leaving the final roller pair to de-energize the motorized drive rollers and energize a momentary brake means and a driver to position the turn gate aligned with the film processor reception opening, and wherein a sensor responsive to the turn gate in alignment with the film processor reception opening energizes the motorized drive rollers to transport the film media out of the buffer storage means.

35. The emulsion down film media transporter as set forth in claim 19, wherein a sensor positioned at and responsive to a trailing end of the film media passing into the reception opening of the film processor to indicate delivery of a sheet of film media.

36. The emulsion down film media transporter as set forth in claim 19, wherein a sensor positioned at and responsive to a trailing end of the film media passing into the reception opening of the film processor to indicate a "fault" when the sensor responsive to the turn gate in alignment with the film processor reception opening remains operated by said alignment.

37. The emulsion down film media transporter as set forth in claim 19, wherein the phototypesetter has cutter means at the film delivery opening to sever the film media into sheet lengths, wherein the turn gate comprises a pair of spaced guides to alternately align with said film guide means and the said processor reception opening and a pair of reversibly motorized drive rollers engageably receiving sheet length film media therebetween for transport into and out of said buffer storage means, wherein a sensor positioned at and responsive to the presence of film media at the final roller pair energizes the motorized drive rollers to transport the film media into the buffer storage means with said turn gate aligned with said guide means, and responsive to a trailing end of the film media leaving the final roller pair to de-energize the motorized drive rollers and energize a momentary brake means and a driver to position the turn gate aligned with the film processor reception opening, wherein a sensor responsive to the turn gate in alignment with the film processor reception opening energizes the motorized drive rollers to transport the film media out of the buffer storage means, and wherein a sensor positioned at and responsive to a trailing end of the film media passing into the reception opening of the film processor to indicate a "fault" when the sensor responsive to the turn gate in alignment with the film processor reception opening remains operated by said alignement.

* * * * *